US005226839A

United States Patent [19]

Koumatsu et al.

[11] Patent Number: 5,226,839

[45] Date of Patent: Jul. 13, 1993

[54] CONNECTOR

[75] Inventors: Seiji Koumatsu; Kimihiro Abe, both of Shizuoka, Japan

[73] Assignee: Yazaki Corporation, Japan

[21] Appl. No.: 935,432

[22] Filed: Aug. 26, 1992

[30] Foreign Application Priority Data

Sep. 4, 1991 [JP] Japan ..... 3-070810[U]

[51] Int. Cl.[5] ..... H01R 13/44

[52] U.S. Cl. ..... 439/595; 439/744; 439/746; 439/871

[58] Field of Search ..... 439/595, 744, 746, 871, 439/872

[56] References Cited

U.S. PATENT DOCUMENTS

| | | | |
|---|---|---|---|
| 3,544,954 | 12/1970 | Yeager | 439/871 |
| 4,114,975 | 9/1978 | Weidler | 439/746 |
| 4,474,417 | 10/1984 | Millhimes et al. | 439/744 |
| 4,863,400 | 9/1989 | Sato | 439/595 |

FOREIGN PATENT DOCUMENTS 61-218081 9/1986 Japan .

*Primary Examiner*—Paula A. Bradley

*Attorney, Agent, or Firm*—Wigman, Cohen, Leitner & Myers

[57] ABSTRACT

A connector comprised of a connector housing including first and second chambers, and a terminal which passes through a first aperture provided between the first and second chambers is disclosed. The terminal comprises a base part having a substantially flat bottom, a tab portion extending from an end of the base part so as to be inserted into the first aperture, a first protrusion protruding upwards from the base part, and a second protrusion protruding downwards from the base part, the first chamber having, an upper wall, and a bottom wall, the bottom wall having a groove for receiving the second protrusion of the terminal therein and a step portion defined by the groove, the step portion having a top surface upon which the second protrusion slides so that the tab portion can be guided into the first aperture.

14 Claims, 3 Drawing Sheets

CONNECTOR

TECHNICAL FIELD

The present invention relates to a connector which comprises a terminal and a connector housing for accommodating the terminal. More specifically, the invention is directed to a connector wherein the connector housing has first and second chambers and the terminal passes through an aperture which is located between the first and second chambers.

BACKGROUND OF THE INVENTION

FIG. 1 is a cross sectional view of a conventional connector in a prior art which is disclosed in Japanese Patent Application Laid Open No. 61-218081.

This type of connector comprises a connector housing 22 constructed of a synthetic resin and a terminal 23 which is accommodated in the connector housing 22.

The terminal 23 is a male type terminal (i.e. a male blade) and has a tab portion 30 and a first protrusion 26 which protrudes upwards from a location approximately in the middle of the terminal 23.

The connector housing 22 includes a first chamber 24 provided with an upper wall 25 and a bottom wall 34 between which the terminal 23 is accommodated. The upper wall 25 has a flexible engaging lance 27 which protrudes therefrom so as to engage with the first protrusion 26 of the terminal 23. Namely, the terminal 23 can be prevented from slipping out of the first chamber 24 by engaging the engaging lance 27 with the first protrusion 26. The connector housing 22 is one of a pair of connectors and includes a second chamber 28 to which the other connector is connected. Further, the connector housing 22 includes a vertical dividing wall 29 provided substantially between the first chamber 24 and the second chamber 28. The first chamber 24 has a guide wall 33 provided between the upper wall 25 and the bottom wall 34 so as to define both a first aperture 31 in the lower side thereof and a second aperture 32 in the upper side thereof.

Normally, in this type of connector 21, when the terminal 23 is inserted into the first chamber 24, the tab portion 30 passes through the first aperture 31 to be accommodated in the second chamber 28. However, if the terminal 23 is accidentally inserted into the first chamber 24 at a considerable tilt as shown in FIG. 2, a tab end 30*a* of the tab portion 30 may climb over the guide wall 33 and invade the second aperture 32, thereby resulting in a misinsertion of the terminal 23 in the first chamber 24.

SUMMARY OF THE INVENTION

In view of the above, an object of the present invention is to solve the aforementioned problems in the prior art through the introduction of a connector wherein a terminal may be properly inserted into a predetermined part, i.e., a first aperture, without fail.

The aforesaid object of the present invention is accomplished through a connector comprised of a connector housing including first and second chambers, and a terminal which passes through a first aperture provided between said first and second chambers, said terminal comprising a base part having a substantially flat bottom, a tab portion extending from an end of said base part so as to be inserted into said first aperture, a first protrusion protruding upwards from said base part, and a second protrusion protruding downwards from said base part, said first chamber having, an upper wall, and a bottom wall, said bottom wall having a groove for receiving said second protrusion of said terminal therein and a step portion defined by said groove, said step portion having a top surface upon which said second protrusion slides so that said tab portion can be guided into said first aperture.

In the above-described connector according to the present invention, when the terminal is inserted into the first chamber and the second protrusion of the terminal slide upon said step portion, the terminal is sandwiched between the engaging lance and the step portion, whereby the terminal is prevented from being inserted at a tilt into the first chamber. Accordingly, the tab portion 5 can pass through the first aperture very smoothly, without fail.

DETAILED DESCRIPTION OF THE PREFERRED EMBODIMENTS

An embodiment according to the present invention will be described hereinafter using FIGS. 3~5.

Figure 1:
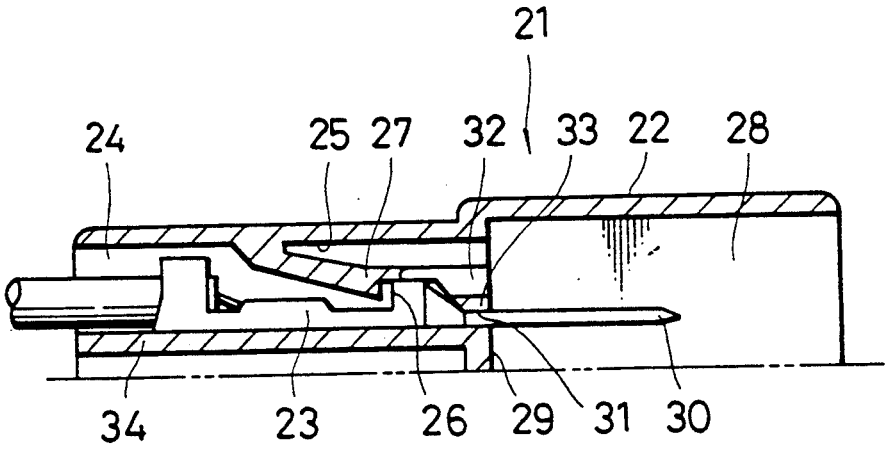
FIG. 1 PRIOR ART
FIG. 1 is a cross sectional view of a connector including a connector housing and a terminal according to a conventional example.
Figure 2:
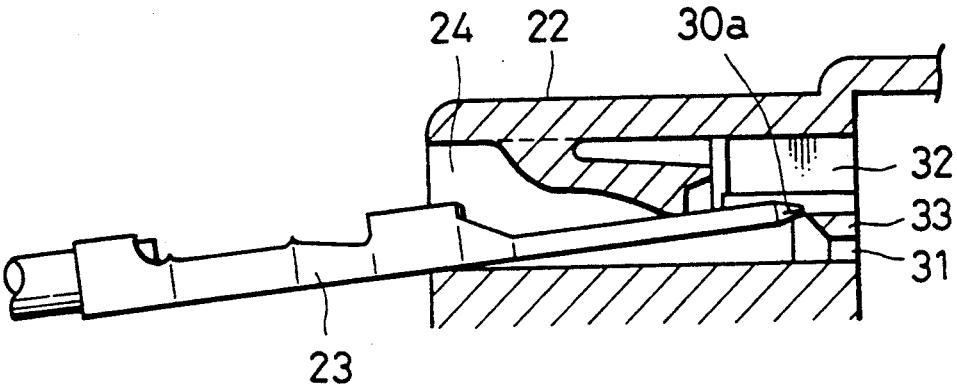
FIG. 2 PRIOR ART
FIG. 2 is an explanatory fragmentary cross sectional view of the connector illustrated in FIG. 1 demonstrating a situation in which a tab portion of the terminal is inserted into an improper portion of the connector housing.
Figures 3, 3A:
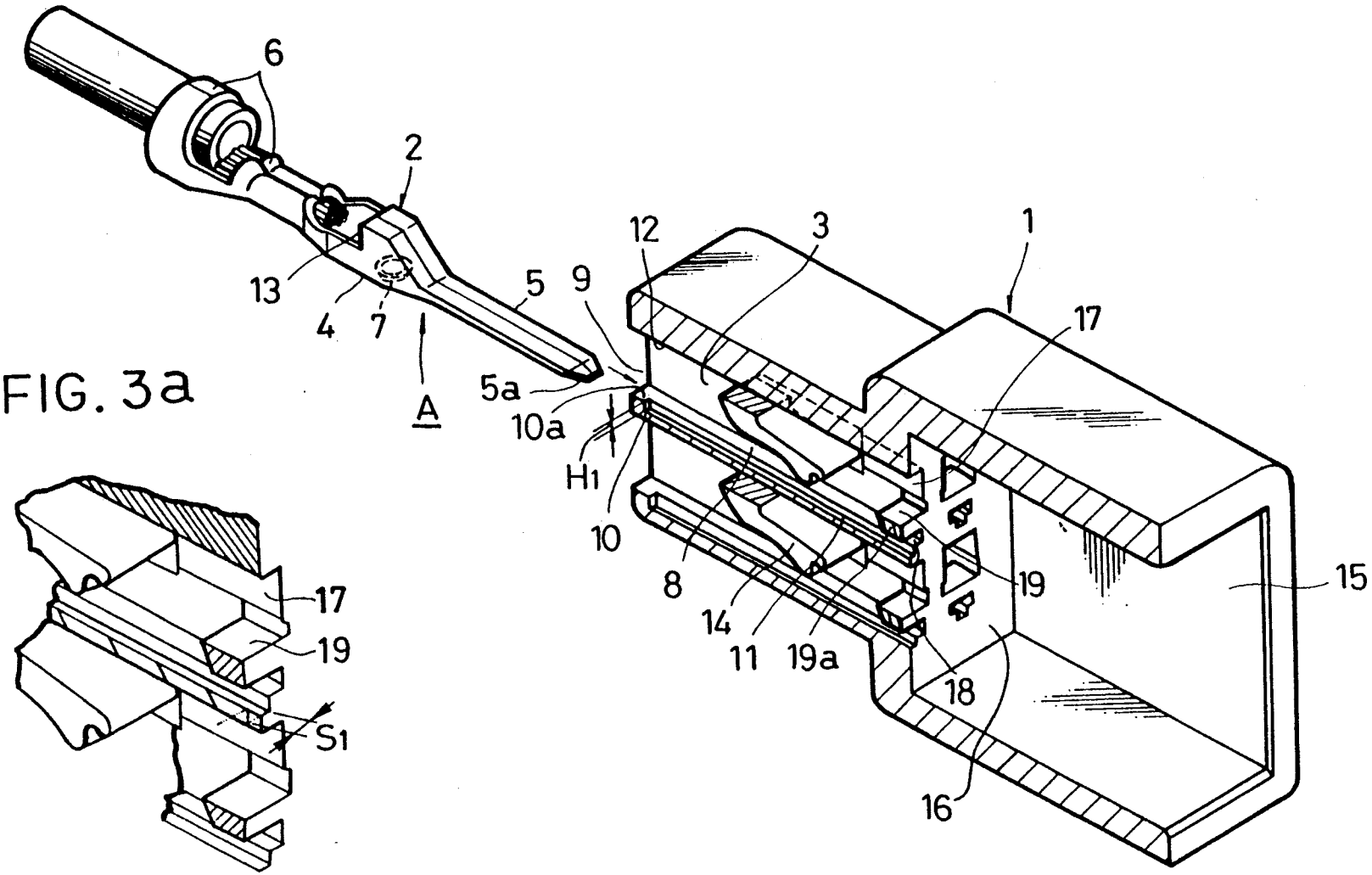
FIG. 3 is a partial cutaway perspective view of a connector including a connector housing and a terminal according to the present invention.
FIG. 3*a* is a partially enlarged perspective view of the connector illustrated in FIG. 3.

FIG. 3 is a partial cutaway perspective view of a connector according to the present invention.

As shown in FIG. 3, the connector comprises a connector housing 1 constructed of a synthetic resin (plastic) and a terminal 2 (which is a male type terminal, i.e. a male blade). The connector housing 1 has first and second chambers into which the terminal 2 is inserted. The connector housing 1 is one of a pair of connectors. The other connector thereof is connected to the second chamber 15.

The terminal 2 has a base part 4 having a substantially flat bottom, a pressure connection portion 6 which is provided on an end of the base part 4 and to which a wire is connected, a tab portion 5 extending from an end of the base part 4, and a first protrusion 13 protruding upwards from the base part 4. Further, the terminal 2 has a second protrusion 7 which protrudes downwards from the flat bottom of the base part 4 and which has a substantially semi-circular cross section.

The first chamber 3 is provided with an upper wall 12 and a bottom wall 8 between which a third aperture 9 is defined. The terminal 2 is inserted into the first chamber 3 through the third aperture 9 and is accommodated between the upper wall 12 and the bottom wall 8. The connector housing 1 includes a vertical dividing wall 16 provided substantially between the first chamber 3 and the second chamber 15. This dividing wall 16 has a guide wall 19 which is provided in the side of the first chamber 3 adjacent to the second chamber 15. Further, the guide wall 19 is provided between the upper wall 12 and the bottom wall 8 so as to define both a first aperture 18 in the lower side thereof and a second aperture 17 in the upper side thereof. The tab portion 5 of the terminal 2 passes through the first aperture 18 so as to be accommodated in the second chamber 15. The upper wall 12 has a flexible engaging lance 14 protruding therefrom so as to engage the first protrusion 13 of the terminal 2. A mold is passed through the second aperture 17 in order to form the engaging lance 14. A side end of the guide wall 19 adjacent to the open end of the first chamber 3 has a slope 19*a* facing the bottom wall 8 so as to guide the tab portion 5 of the terminal 2 to the first aperture 18 smoothly.

The bottom wall 8 contains a groove 11 which has a cross section of a rectangular shape and allows the second protrusion 7 of the terminal 2 to be received therein, as well as a step portion 10 which is defined by the groove 11 so as to have a flat top face which is a part of the surface of the bottom wall 8.

Figure 4:
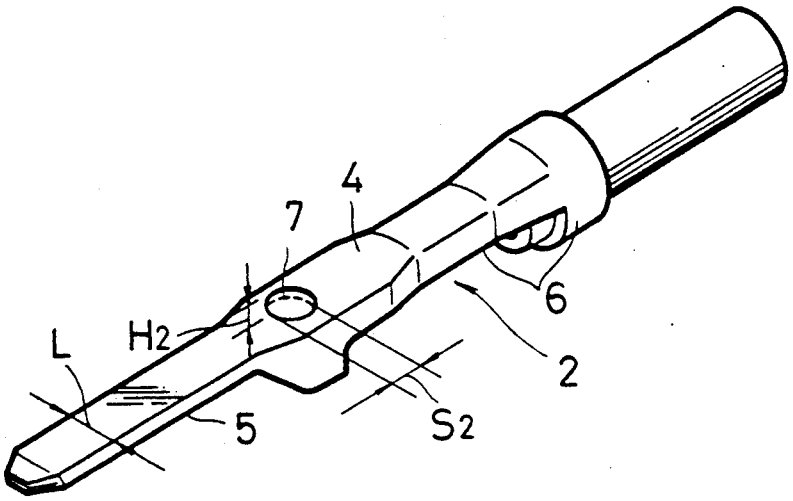
FIG. 4 is a perspective view of the terminal taken in a direction shown by an arrow A of FIG. 3.

FIG. 4 is a perspective view of the terminal 2 taken in a direction shown by an arrow A of FIG. 3. As shown in FIGS. 3, 3*a*, and 4, the groove 11 of the first chamber 3 has a depth H1 which is longer than a height H2 of the second protrusion 7 of the terminal 2, as well as a width S1 which is longer than a radius S2 of the second protrusion 7 and smaller than a width L of the tab portion 5 of the terminal 2.

Figure 5:
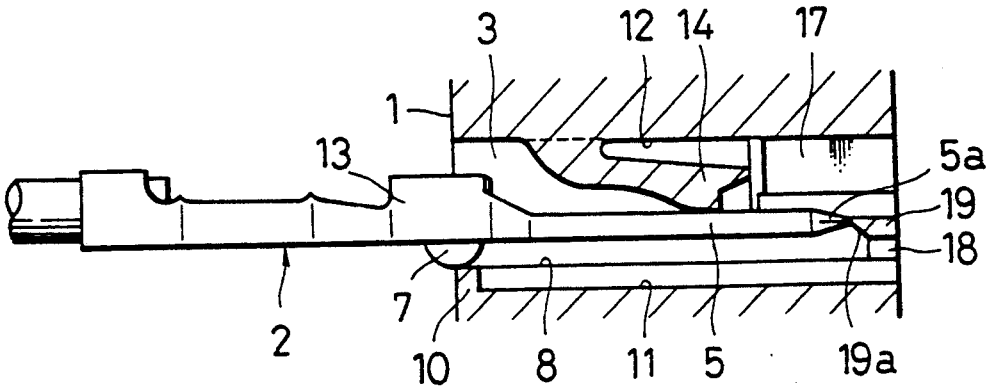
FIG. 5 is a cross sectional view of the connector illustrated in FIG. 3 illustrating a state in which a second protrusion of the terminal slides upon a step portion of the connector housing, thereby preventing a tab portion from being inserted into an improper portion of the connector housing.

As shown in FIG. 5, when the terminal 2 is inserted halfway into the first chamber 3 and a tab end 5*a* of the terminal 5 is abutted against the guide wall 19, the second protrusion 7 of the terminal 2 slides upon the top surface 10*a* of the step portion 10 of the first chamber 3 and the terminal 2 is sandwiched between the engaging lance 14 and the step portion 10. In this way, the terminal 2 is prevented from tilting. Accordingly, a tab end 5*a* is guided smoothly by the slope 19*a* of the guide wall 19 to the first aperture 18 and is prevented from being inserted into the second aperture 17, and the tab portion 5 passes through the first aperture 18 very smoothly, without fail. That is, the terminal 2 is properly inserted into the first chamber 3.

In the above-described embodiment, the step portion 10 is provided on an open end of the first chamber 3, but the position of the step portion 10 should not be limited to that location. In other words, the step portion 10 may be provided anywhere along the bottom wall 8, for example, in a middle portion thereof, as long as the step portion 10, together with the second protrusion 7, can work in combination to prevent the tab portion 5 from being inserted at a tilt into the connector housing 1. That is, the positions of the second protrusion 7 and the step portion 10 may be determined based on a correct balance between the second protrusion 7 and the step portion 10 themselves.

What is claimed is:

1. A connector comprised of a connector housing including first and second chambers, and a terminal which passes through a first aperture provided between said first and second chambers.

said terminal comprising a base part having a substantially flat bottom, a tab portion extending from an end of said base part so as to be inserted into said first aperture, a first protrusion protruding upwards from said base part, and a second protrusion protruding downwards from said base part, said first chamber having, an upper wall, and a bottom wall, said bottom wall having a groove for receiving said second protrusion of said terminal therein and a step portion defined by said groove, said step portion having a top surface upon which said second protrusion slides so that said tab portion can be guided into said first aperture.

2. The connector as set forth in claim 1, wherein said first chamber has a guide wall provided adjacent to said second chamber between said upper wall and said lower wall so that said guide wall and said bottom wall define said first aperture and having a slope facing said bottom wall.

3. The connector as set forth in claim 2, wherein said step portion is defined so that said second protrusion of said terminal slides upon said top surface of said step portion when said tab portion abuts against guide wall.

4. The connector as set forth in claim 3, wherein said upper wall has a flexible engaging lance protruding therefrom so as to abut against said terminal and engage said first protrusion.

5. The connector as set forth in claim 1, wherein said groove has a rectangular cross section.

6. The connector as set forth in claim 5, wherein said second protrusion has a substantially semi-circular cross section.

7. The connector as set forth in claim 6, wherein said groove of said first chamber has a depth (H1) and a width (S1), said depth (H1) being longer than a height (H2) of said second protrusion of the terminal, said width (S1) being larger than a radius (S2) of said second protrusion of the terminal and smaller than a width (L) of said tab portion.

8. The connector as set forth in claim 1, wherein said top surface of said step portion is a part of said bottom wall.

9. The connector as set forth in claim 8, wherein said first chamber has a guide wall provided adjacent to said second chamber between said upper wall and said lower wall so that said guide wall and said bottom wall define said first aperture and having a slope facing said bottom wall.

10. The connector as set forth in claim 9, wherein said step portion is defined so that said second protrusion of said terminal slides upon said top surface of said step portion when said tab portion abuts against guide wall.

11. The connector as set forth in claim 10, wherein said upper wall has a flexible engaging lance protruding therefrom so as to abut against said terminal and engage said first protrusion.

12. A connector comprised of a connector housing including first and second chambers, and a terminal which passes through a first aperture provided between said first and second chambers, said terminal comprising a base part having a substantially flat bottom, a tab portion extending from an end of said base part so as to be inserted into said first aperture, a first protrusion protruding upwards from said base part, and a second protrusion protruding downwards from said base part, said first chamber having, an upper wall having a flexible engaging lance protruding therefrom so as to abut against said terminal and engage said first protrusion, a bottom wall having a groove and a step portion, and a guide wall being provided adjacent to said second chamber between said upper wall and said lower wall so that said guide wall and said bottom wall define said first aperture and having a slope facing said bottom wall, said groove provided for receiving said second protrusion of said terminal therein and having a rectangular cross section, said step portion defined by said groove and having a top surface upon which said second protrusion slides when said tab portion abuts against guide wall so that said tab portion can be guided into said first aperture.

13. The connector as set forth in claim 12, wherein said second protrusion has a substantially semi-circular cross section.

14. The connector as set forth in claim 13, wherein said groove of said first chamber has a depth (H1) and a width (S1), said depth (H1) being longer than a height (H2) of said second protrusion of the terminal, said width (S1) being larger than a radius (S2) of said second protrusion of the terminal and smaller than a width (L) of said tab portion.

* * * * *